United States Patent [19]

Vayssiere et al.

[11] 4,101,313

[45] Jul. 18, 1978

[54] PROCESS AND APPARATUS FOR THE PRODUCTION OF STEEL

[75] Inventors: Pierre Vayssiere; Aristide Berthet, both of Metz, France

[73] Assignee: Institut de Recherches de la Siderurgie Francaise (IRSID), St. Germain-en-Laye, France

[21] Appl. No.: 732,362

[22] Filed: Oct. 14, 1976

[30] Foreign Application Priority Data

Oct. 14, 1975 [FR] France ..... 75 31335

[51] Int. Cl.[2] ..... C21C 5/38; C21C 5/40

[52] U.S. Cl. ..... 75/60

[58] Field of Search ..... 75/60, 11

[56] References Cited

U.S. PATENT DOCUMENTS

| | | | |
|---|---|---|---|
| 2,805,930 | 9/1957 | Udy | 75/11 |
| 3,912,501 | 10/1975 | Castejon | 75/11 |

*Primary Examiner*—Peter D. Rosenberg
*Attorney, Agent, or Firm*—Kurt Kelman

[57] ABSTRACT

In the production of steel from pig iron melted and refined in a vessel, the pig iron is preheated in two phases. In the first preheating phase, the cold pig iron and hot gases recovered from the melting and refining vessel are moved simultaneously through a first and higher rotary tubular furnace whose lower open end is in communication with an upper open end of a second and lower rotary tubular furnace constituting a second preheating phase. The second furnace is heated from the outside to regulate the temperature of the pig iron to a desired value before it is introduced into the vessel from the second furnace.

5 Claims, 4 Drawing Figures

PROCESS AND APPARATUS FOR THE PRODUCTION OF STEEL

Figure 1:
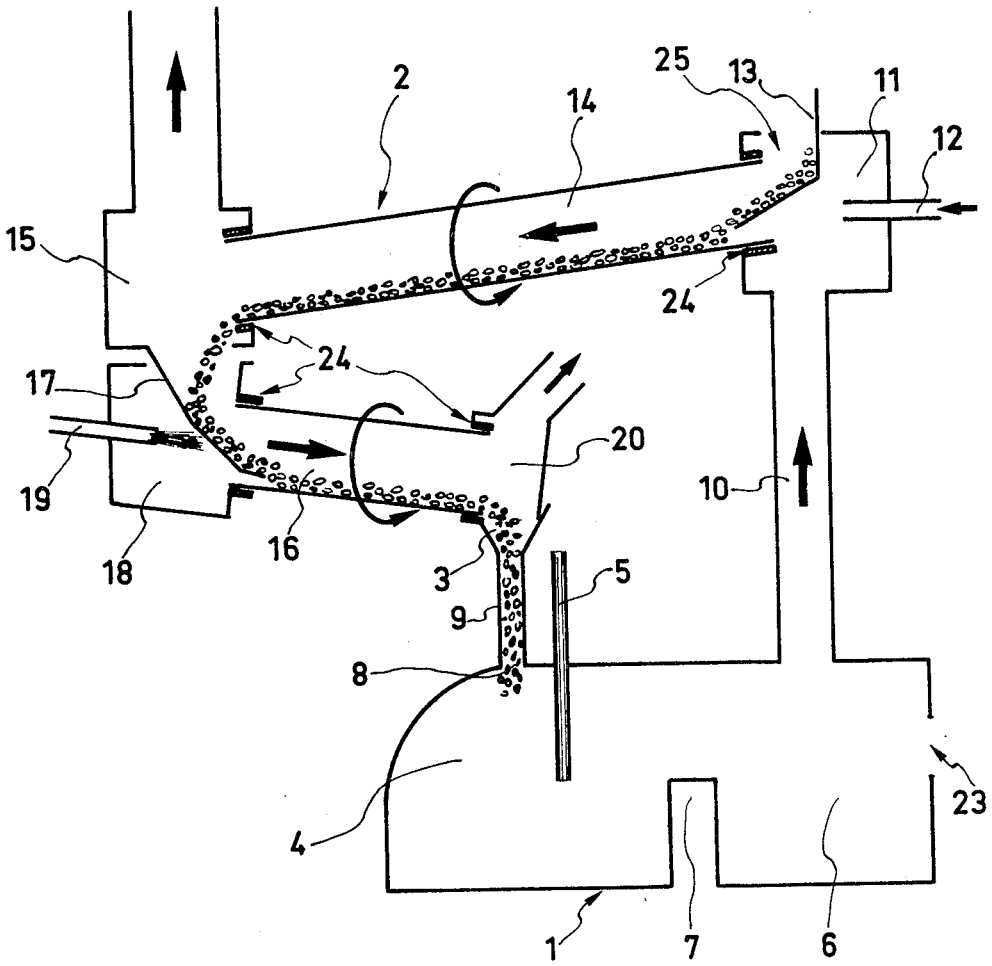

The present invention relates to the production of steel from a carburized metallic charge consisting at least partially of solid materials rich in iron, and more particularly to improvements in the preheating the metallic charge before it is introduced into a melting and refining vessel.

The term "solid materials rich in iron" is used herein to define in a generic manner any charge used in the production of steel in a melting and refining vessel, the composition and nature of the charge depending on the specific metallurgical apparatus and process used. For example, a charge for an electric arc furnace may be composed of pig iron, pre-reduced iron sponge, or the like, containing at least 80% iron in every chemical form, elemental or in compounds with other elements, the 80% iron, in turn, containing at least 80% elemental iron or "metallic iron".

Certain operations in the production of metals, particularly of steel, require high operating temperatures frequently in excess of the melting point of the charge. If the metallic charge consists partially or totally of solid materials, yields are usually enhanced by preheating the materials before they are introduced into the vessel for treating the charge. This is the case, for example, in refining operations wherein at least a portion of the original metallic charge is constituted by solid iron materials. It has been found economically advantageous to effect such preheating by means of the hot gases recovered from the refining operation.

Various proposals have been made in this connection, as exemplified by French Pat. No. 1,434,287 and U.S. Pat. No. 1,760,078 which disclose a continuous refining process with preheating of the solid charge rich in iron metal by causing the refining gases to circulate countercurrently to the charge while the charge is moved to the refining vessel. Heating is obtained by the fractional combustion of carbon oxide contained in the refining gases so that the charge encounters during the preheating gases whose carbon oxide content increases proportionally to the increase in the temperature. This permits the limitation of the oxidization of the charge to a maximum during the preheating stage.

The optimum efficiency of this process makes it necessary, however, to introduce the preheated charge into the refining vessel by the conduit used to recover the refining gases or by a conduit as close as possible thereto so as to avoid as much as possible any undesirable cooling of the charge just before it is introduced into the refining vessel. This limits the application of the process and causes difficulties, for instance, when it is to be used in a continuous pneumatic pig iron refining installation where the introduction of the solid charge into the vessel and the evacuation of the refining gases therefrom are effected in a well known manner through ports which are spaced far apart, the inlet port for the charge being in the reactor, where the refining reactions take place, and the outlet port for the refining gases being in an adjacent decanter where the metal is separated from the slag. The utility of this known preheating system has a second limitation connected to the nature of the solid charge to be preheated. Actually, the process is no longer fully justified if the solid iron materials are carburized (granules of pig iron) because, in this case, it would less avoid oxidation than decarburization of the metal. This, however, does not generally constitute a major obstacle to the further treatment of the charge. Since the carbon component is soluble in the molten metal, it could make a contribution in the refining vessel, if necessary. A final disadvantage of the known process resides in the difficulty of controlling and regulating the final temperature of the solid charge before it is introduced into the refining vessel.

It is the primary object of this invention to overcome these disadvantages in the preheating of a carburized metallic charge consisting at least partially of solid materials rich in iron in the production of steel.

It is a concomitant object of the invention to provide a preheating system of general utility for continuous as well as batch refining, for oxygen converters as well as electric arc furnaces.

The above and other objects and advantages are accomplished in a steel production process which comprises introducing the charge into a melting and refining vessel, melting and refining the charge in the vessel by subjecting the charge to a melting temperature and refining agents whereby hot gases develop in the vessel, and recovering the hot gases. In accordance with the present invention, the charge is subjected to a two-phase preheating before it is introduced into the vessel. A first preheating phase receives the recovered hot gases and the cold charge, the hot gases and cold charge being in contact until the temperature of the charge has been raised and the hot gases and charge being moved simultaneously. A second, separate and succeeding preheating phase receives the charge whose temperature has been raised from the first phase and a controlled amount of calories is supplied from the outside to the second phase while the charge is moved therethrough until the final temperature of the charge has been adjusted to a desired value. The charge having the desired temperature is introduced from the second preheating phase into the vessel.

The calories may be supplied in the form of a current of hot gases and, depending on the nature of the charge, the direction of circulation of the charge and the gases may be the same, opposed in both preheating phases, or the same in one phase and opposed in the other phase.

This invention also provides an apparatus for the production of steel, which comprises a melting and refining vessel for the charge, the vessel including an inlet for the charge and a chimney for discharging hot refining gases, and a two-phase preheating installation for preheating the charge before it is introduced into the vessel through the inlet. The installation includes two consecutively arranged and superposed rotary tubular furnaces, each furnace constituting a respective phase and having an upper and a lower open end, the furnaces being inclined with respect to the horizontal. The first and higher furnace has an inlet for receiving the charge at the upper open end and means in communication with the chimney for receiving the discharged hot refining gases and for circulating the gases through the furnace. The second and lower furnace has an upper open and in communication with the lower open end of the first furnace and the lower open end in communication with the inlet of the vessel, the charge from the first furnace being received in the second furnace through the communicating open ends of the furnaces and being discharged from the second furnace into the inlet. The second furnace is heated from the outside.

Thus, the charge is preheated in two successive and distintly different phases. In the first phase, the charge is preheated in contact with a current of the recovered hot refining gases. Preferably, these gases are first burned by air or oxygen-enriched air. In this way, the calories obtained from the heat of the gases as well as that from the combustion of the carbon oxide they contain are utilized. The heat exchange between the solid charge and the hot gases is effected while the charge is being transferred to the second preheating phase. The partially preheated charge is then brought to the desired temperature in the second phase which is controllably heated from the outside so as to avoid melting of the charge before it is introduced into the refining vessel. Any suitable heating means may be used, such as a burner.

The above and other objects, advantages and features of the present invention will be more fully understood from the following detailed description of certain now preferred embodiments thereof, taken in conjunction with the accompanying drawing schematically illustrating apparatus according to this invention and wherein FIGS. 1 to 4 show respective embodiments of a preheating installation combined with refining apparatus using oxygen conversion.

To simplify the description, the same reference numerals designate like parts operating in a like manner in all figures of the drawing. Metallurgical vessel 1 is of a known type, such as disclosed in French Pat. No. 1,407,082, for the continuous refining of metals and this melting and refining vessel is associated with preheating installation 2 mounted thereabove to preheat solid charge 3 which, by way of example, is assumed to consist of granulated pig iron. The vessel being conventional and its specific structure not forming part of the invention, it is schematically shown to comprise reactor 4 whereinto preheated charge 3 is introduced through inlet port 8 and where the charge is melted and refined, for example by blowing oxygen through nozzle 5, and decanter 6 which is separated from the reactor by dividing wall 7 and in which the steel is separated from the slag. Inlet port 8 has a funnel-shaped hopper 9 facilitating the introduction of the pig iron charge into the vessel. The decanter has a chimney 10 for removing and recovering the gases produced by the refining reactions. Two outlet ports (not shown) remove the refined metal and the slag from the decanter portion of the vessel. The decanter also has a lateral port 23 disposed above dividing wall 7 for introducing solid additives, such as scrap iron, into the reactor by means, for example, of a charging arm (not shown) traversing the decanter and discharging into the reactor above dividing wall 7. The metallic bath in the reactor portion of the vessel produces, under the action of the oxygen blown in through nozzle 5, refining gases composed essentially of cumbustible CO and $CO_2$ in the proportion of about 85 : 15. These hot gases are sucked into chimney 10 in the form of a gaseous current.

Two-phase preheating installation 2 for preheating charge 3 before it is introduced into vessel 1 through inlet 9, 8 includes two consecutively arranged and superposed rotary tubular furnaces 14 and 16. Each furnace constitutes a respective one of the preheating phases and has an upper and a lower open end, the furnaces being inclined with respect to the horizontal. The slight inclination of the furnaces by a few degrees enables granules 3 to descend in the furnaces at a reduced speed while they move in an axial direction therethrough.

To avoid unduly burdening the description, the ends of the furnaces will be designated as "upstream" and "downstream" ends, depending on the direction of circulation of solid charge 3. Thus, the upstream end will correspond through the description to the end of the furnace into which the charge is introduced while the downstream end will designate the end of the furnace from which the charge is discharged. The upstream and downstream ends of the furnaces are, respectively, the upper and lower ends thereof.

As shown by the circular arrows, rotary furnaces 14 and 16 are mounted for rotation in bearings 24 supporting each end of the furnaces, the directions of movement of the gases being shown by straight arrows in all figures. The first and higher rotary furnace is designated 14, and the second and lower furnace is designated 16. Furnace 14 has an inlet for receiving charge 3 at the upper end, a baffle or guide member 13 facilitating the movement of the charge into the furnace for its descent through the furnaces into vessel 1.

In the embodiment of FIG. 1, the open upstream end of each furnace is in communication with a respective heating chamber 11 and 18, and the open downstream end with a respective suction hood 15 and 20. Heating chamber 11 defines port 25, guide member 13 extending through port 25 to constitute the inlet for the charge. Chimney 10 leads into the heating chamber which thus constitutes a means in communication with the chimney for receiving the discharged hot refining gases and suction hood 15 constitutes a means for circulating the gases through furnace 14. As shown, the recovered refining gases are burned in chamber 11 before they are brought into contact with charge 3 in furnace 14. Oxygen or air enriched with oxygen is delivered into chamber 11 through inlet 12 whereby the recovered refining gases are burned or oxidized in chamber 11.

Second and lower furnace 16 has its upper open end in communication with the lower open end of furnace 14, and the lower open end of furnace 16 is in communication with inlet 9, 8 of vessel 1, inlet hopper 9 being connected to suction hood 20. Suction hood 15 and heating chamber 18 constitute the means of communication between the respective ends of the furnaces. A burner 19 extends into heating chamber 18 to supply a controlled amount of calories from the outside to the second furnace while charge 3 is moved therethrough, which permits the final temperature of the charge to be adjusted to a desired value before it is introduced into vessel 1. The burner produces hot combustion gases and chamber 18 may, therefore, be called a combustion chamber to differentiate it from oxidizing chamber 11 where the refining gases are burned. The reagents of combustion may be a mixture of air and hydrocarbons, either gaseous or liquid, any desired fuel being suitable.

The operation of this apparatus will be partially obvious from its structure and the preheating will proceed in the following manner.

The refining gases flowing out of vessel 1, through chimney 10 and into chamber 11 will be oxidized therein by feeding oxygen-enriched air through inlet 12. The hot gases will then be sucked through the upper end of furnace 14 and through the furnace by suction hood 15 whereby the gases are circulated through the furnace in contact with charge 3 moving through the rotating furnace in contact with the concurrently flowing gases. Through heat exchange, the pig iron granules introduced into the furnace by chute 13 will be gradually heated to higher temperatures as they pass through the furnace, the degree of inclination of furnace 14 and its length being suitably selected in a manner well known to those skilled in the art to assure that the dwell time of the charge in the furnace suffices to enable a temperature equilibrium between charge and gases to be reached at the lower end of the furnace without unduly extending the length of the furnace and thus to reduce thermal losses to a minimum. The rotation of the furnace facilitates the displacement of the charge through the furnace and its stirring so as to enhance the contact between the charge and hot gases for best heat exchange. At the lower end of furnace 14, the exhausted gases are evacuated through hood 15.

After this first preheating phase, the solid charge passes from the lower open end of higher furnace 14 into the upper open end of lower furnace 16, being guided thereinto by chute 17 mounted in combustion chamber 18 which interconnects the two open furnace ends. Burner 19 is regulated to supply a controlled amount of calories and thus to adjust the temperature of the charge entering vessel 1 to a desired value. The combustion gases are sucked through furnace 16 by suction hood 20 in communication with the lower end of the furnace and are directed to a recovery apparatus (not shown) where dust is removed from the gases. The gases and charge move concurrently through the second preheating phase identically to the direction of circulation in the first phase.

Among other things, the thermal efficiency of the second preheating phase depends on the fullest possible use of the combustion gases in furnace 16. Therefore, it will be advantageous to avoid too rapid evacuation of the gases through hood 15, which would have the added disadvantage of disturbing the regulation of the removal of the refining gases through furnace 14. To prevent this, the opening through which suction rod 15 and combustion chamber 18 communicate to permit pig iron granules 3 to pass is reduced as much as possible to minimize gas flow therethrough. If for some technical reason in certain installations this turns out to be difficult, it may be advisable to omit the application of suction through hood 15. In this case, circulation of the refining gases through furnace 14 and of the combustion gases through furnace 16 is produced solely by suction through hood 20 so that the refining gases pass not only through furnace 14 but also through furnace 16. This somewhat reduces the thermal efficiency because a parasitic reheating of the refining gases is unavoidable in furnace 16, to the detriment of heating the solid charge. However, generally, this reduction in efficiency is less than that resulting from an excessively rapid evacuation of combustion gases through suction in hood 15.

It must be noted that, if the solid charge consists primarily of scrap iron or pre-reduced materials or other weakly carburized metallic materials, operating in this manner could risk an increase in the oxidation of the materials within lower furnace 16 in the second phase by the burned refining gases which contain about 50%, by weight, of $CO_2$, the materials having been brought to an elevated temperature in the first preheating phase.

Preferred to the above mode of operation but more delicate is controlling the suction through hoods 15 and 20 in such a manner as to obtain uniform, or substantially uniform, pressure in the zone of communication between hood 15 and combustion chamber 18. With such a pressure equilibrium, there will be no or little gas flow through this zone, thus preventing flow of refining gases into second furnace 16 as well as flow of combustion gases through hood 15. The only exchange between the refining and combustion gases in the two preheating phases will occur due to natural convection between the very hot combustion gases and the cooled refining gases. This will be too insignificant to influence the thermal efficiency in a substantial manner.

It should also be noted that, depending on the amount of calories desired in the second preheating phase, refining gases may be entrained into furnace 16 by a well known jet effect resulting from turning burner 19 higher. In the case of weakly carburized solid charges, this will have the same disadvantage as has been indicated hereinabove in connection with the less preferred mode of operation. As indicated, this will desirably be prevented, for example, by controlling the size of the zone of communication between chamber 18 and hood 15 or by adjusting the respective suctions in hood 15 and 20 in response to the operation of burner 19 so that the pressure differential is substantially zero in this zone of communication.

Figure 2:
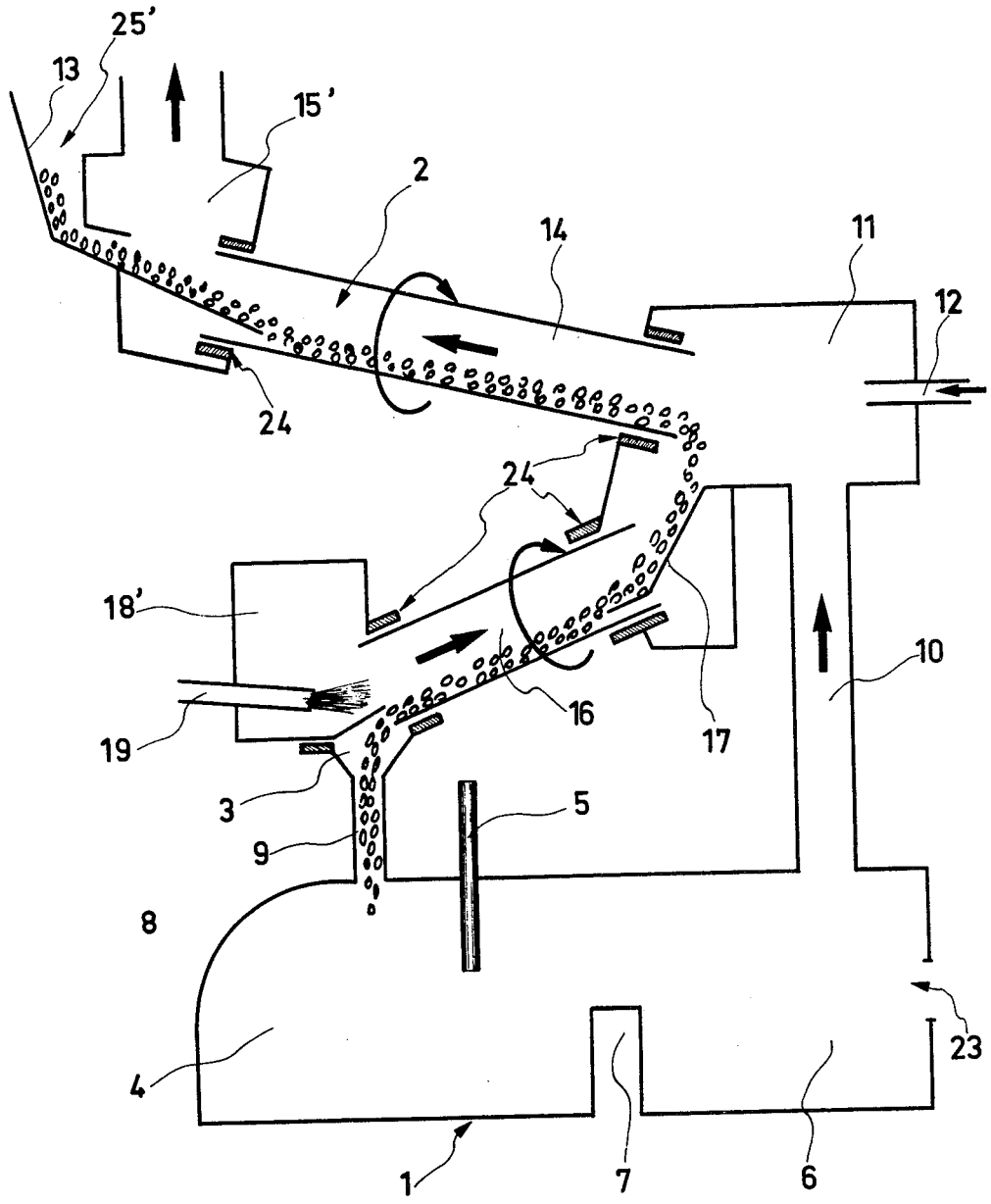

Like reference numerals being applied to like parts operating in a like manner in FIG. 2, the structure and operation of this embodiment will be self-evident from the above description of the embodiment of FIG. 1. In the embodiment of FIG. 2, the gases circulate through both furnaces countercurrently to the movement of charge 3 therethrough. Suction hood 20 is eliminated in this embodiment and furnaces 14 and 16 communicate with each other through oxidizing chamber 11 which is mounted between the lower end of first furnace 14 and the upper end of second furnace 16. Combustion chamber 18' is mounted at the lower end of furnace 16 and suction hood 15' is mounted at the upper end of furnace 14 for circulating the combustion gases and the refining gases through the interconnected furnaces. Inlet chute 13 for charge 3 extends through inlet port 25' in hood 15' to deliver the cold charge into the preheating installation.

Figure 3:
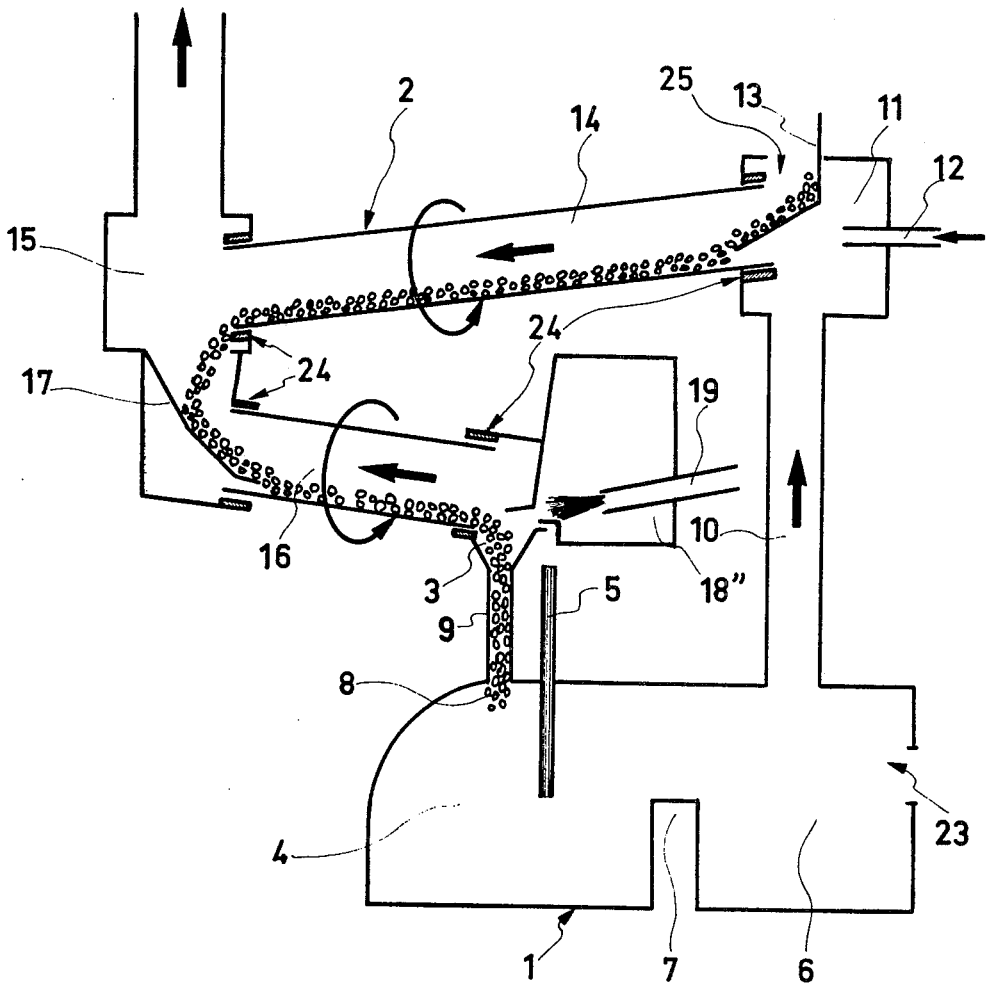

FIG. 3 illustrates yet another embodiment in which the refining gases and charge 3 circulate in the same direction through first phase furnace 14 while the combustion gases and charge circulate countercurrently in second phase furnace 16. The first preheating phase is substantially the same as that in FIG. 1 but combustion chamber 18" for the second phase furnace is mounted at the lower, instead of the upper, end of furnace 16 where the combustion chamber replaces suction hood 20. As in the embodiment of FIG. 2, suction hood 15 serves to circulate the gases through both furnaces.

Figure 4:
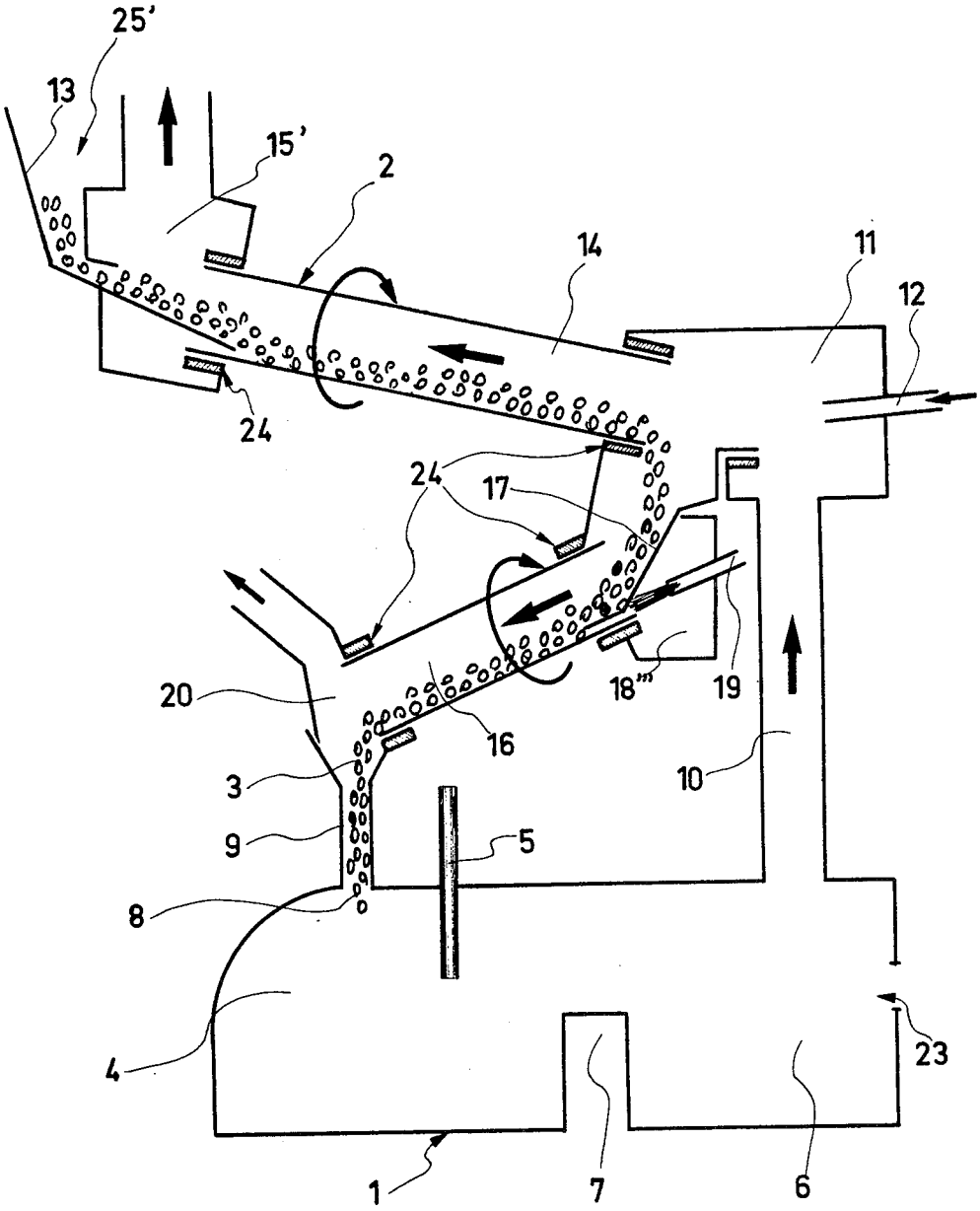

In the embodiment of FIG. 4, the gases and charge circulate countercurrently through furnace 14 and concurrently through furnace 16. The first preheating phase is substantially the same as that in FIG. 2 but combustion chamber 18''' is mounted at the upper, instead of the lower, end of furnace 16 while suction hood 20, which is omitted in the embodiment of FIG. 2, is mounted at the lower end of furnace 16. Similarly to the embodiment of FIG. 1, suction hoods 15 and 20 serve to circulate the refining gases and the combustion gases respectively through furnaces 14 and 16. Obviously, the same consideration as explained in connection with FIG. 1 in connection with the zone of communication between the furnaces applies to this embodiment.

As will be appreciated from the above description, the present invention makes it possible to re-use the hot refining gases for the preheating of the metallic charge before it is introduced into the refining vessel. It may be readily applied to continuous or batch refining but it will be more advantageously used in continuous refining operations which uninterruptedly produce gases of a substantially unchanged chemical composition.

Any type of metallic charge presently used in metallurgical operations may be preheated in accordance with this invention, whether it be granulated pig iron, pre-reduced materials or scrap iron. With the latter materials used particularly in electric arc furnaces, care must be taken not to subject the charge to oxidation during the preheating. In the case of pig iron, the principal risk resides in an agglomeration of the granules above a temperature of 900° C. Therefore, it will be advisable to adapt the direction of circulation between charge and gases according to the nature of the charge. When the charge and the gases circulate countercurrently, the solids will be in contact with gases whose content in carbon oxide will increase proportionally to the descent of the charge in the furnace, thus reducing the risk of oxidizing the charge. Contrariwise, local overheating and agglomeration will occur more readily when the charge encounters gases which become hotter and hotter during the flow of the charge through the furnaces. Actually, in the first preheating phase where the cold charge is in contact with the hot refining gases, the chances of overheating or oxidation are relatively small because the charge is still relatively cold and the content of $CO_2$ in the burned gases (about 40%) is insufficient in volume to cause substantial oxidation. Thus, the most advantageous arrangement will be selected according to the type of charge used, taking into consideration the optimal thermal efficiency obtainable according to the considerations outlined hereinabove.

In the embodiments illustrated and described hereinabove, the total charge fed to vessel 1 is solid but it will be understood that only part of the charge may consist of pig iron granules while part of it may, for example, be pig iron in the liquid state fed to reactor 4 in a known manner through a lateral input port (not shown).

While preheating will be facilitated if the charge is in the divided state, such as granules of pig iron, as shown, pellets of pre-reduced metallic materials or finely shredded scrap iron may also be used. The charge may even be in a more or less pulverized condition, in which case it will be advantageous to fluidize the charge in the refining gases as they concurrently flow through the first phase furnace.

As far as the chemical composition of the charge is concerned, it may be substantially pure iron, with a few percentages of iron oxides, or iron combined or mixed with reducing agents, particularly carbon.

Obviously, preheating according to the invention will be possible only in combination with the metallurgical vessel in which hot refining gases are produced during refining, which are relatively non-oxidizing with respect to iron, preferably combustible and, at any rate, in sufficient quantities to make their recovery economical. Thus, advantageous use of this invention presupposes the presence of a carburized metallic bath in the refining vessel so that the refining agents therein will produce refining gases meeting the above criteria.

The necessary carbon may be introduced into the metal bath in the vessel by any suitable means, particularly by an addition to the molten charge or by the presence of carbon in the solid starting materials themselves; also by a complementary feed of liquid pig iron, as explained hereinabove, or by a combination of these measures. Thus, the preheating system herein disclosed may be applied to metallurgical apparatus other than continuous refining of pig iron by air, for instance to an electric arc furnace fed by weakly carburized metallic solid materials, such as scrap iron, pre-reduced materials, sponge iron and the like. The addition of carbon may be effected in a simple and conventional manner, by an initial feed of solid pig iron which rapidly forms a liquid mass at the bottom of the bath.

In the latter case, it is advantageous to supply air for oxidizing the metallic bath and thus to form a combustible gas. The air is preferably supplied through a lateral wall of the furnace at a location remote from the chimney through which the refining gases are evacuated from the furnace. Since the quantity of combustible gas is, in this special instance, less than that obtained in the continuous refining of pig iron by air, it may be desirable to provide an auxiliary source of combustible gas at the oxidizing chamber. Furthermore, to avoid oxidation of the charge in the second rotary furnace, it is preferred to use a burner with a non-oxidizing flame, for example a burner using liquid or gaseous hydrocarbon fuel.

While, as indicated hereinabove, the choice of gas flow direction with respect to the flow of charge will depend on a number of factors, experience has shown that, for pig iron granules, the preferred modes of operation are:

(1) Countercurrent flow in the first phase and concurrent flow in the second phase (FIG. 3).

(2) Concurrent flow in the first phase and in the second phase (FIG. 1).

The two other embodiments have been found to be less advantageous, the least preferred flow pattern being countercurrent flow in both phases (FIG. 2).

On the other hand, the preferred mode of operation for scrap iron and pre-reduced charges, in descending order of interest is:

(1) Countercurrent in the first phase and in the second phase.

(2) Countercurrent in the first phase concurrent in the second phase.

(3) Concurrent in the first phase and countercurrent in the second phase.

(4) Concurrent in the first and second phases.

Preheating of granulated pig iron charges (hematite) was effected with the two-phase system herein disclosed by utilizing gases coming from a continuous refining vessel. A little air was supplied at the level of the decanter of the refining vessel and the evacuated refining gases left the vessel at a temperature of 1500° C and, per ton of pig iron, had the following composition:

61.5 $m^3$ CO
19.4 $m^3$ $CO_2$
6.5 $m^3$ $N_2$ giving a total volume of 87.4 $m^3$ of gas, requiring for its complete combustion 154 $m^3$ of air at 25° C temperature, the gas volumes being measured at normal pressure and temperature.

The granulated pig iron was preheated with concurrent flow of the gases in both phases (FIG. 1). In the course of the first phase heating, the temperature of the charge was raised from 25° C to 800° C. The burned refining gases left the first furnace at a temperature of 1030° C, the volume of the evacuated gases being 207 $m^3$ of which 81 $m^3$ was $CO_2$ and 126 $m^3$ was $N_2$, measured at normal pressure and temperature. In the second phase, the pig iron charge temperature was raised from 800° C to 900° C. This was accomplished with a burner consuming 5.5 l fuel and 52.1 $m^3$ air at 25° C per ton of pig iron. The burned gases were evacuated at a temperature of 1100° C, after they heated the charge in the second furnace, their volume, measured at normal temperature and pressure, being 50.34 $m^3$ of which 7 $m^3$ was $CO_2$, 40 $m^3$ was $N_2$ and 3.34 $m^3$ was water.

It will be understood that many variations and modifications may be introduced into the process and apparatus without departing from the spirit and scope of the present invention. More particularly, any outside heating means other than a burner may be used to supply desired amounts of calories to the second phase furnace. Also, the spatial arrangement of the two preheating furnaces may be varied in a manner best to facilitate the introduction of the preheated charge into the refining vessel and to receive the recovered refining gases therefrom. It would be possible, for example, to have a bank of refining vessels of which each feeds its refining gases to a preheating system for another one of the vessels. Similarly, the oxidation of the carbon oxide contained in the recovered refining gases before they are fed to the first preheating phase may not be necessary in all cases, particularly where the desired value of the temperature of the charge at the end of the preheating does not warrant it.

What is claimed is:

1. A process for the production of steel from a carburized metallic charge comprising solid materials rich in iron, which comprises (a) subjecting the charge to a two-phase preheating below the melting temperature of the solid materials, (1) the cold charge being received in a first preheating phase and (2) the charge whose temperature has been raised in the first preheating phase being received in a second, separate and succeeding preheating phase, (b) introducing the preheated charge from the two-phase preheating into a melting and refining vessel, (c) melting and refining the preheated charge in the vessel by subjecting the charge to a melting temperature and refining agents whereby hot gases develop in the vessel (d) recovering the hot gases, (e) delivering the recovered hot gases to the first preheating phase where the hot gases and the cold charges are in contact until the temperature of the charge has been raised, the hot gases and the charge being moved simultaneously in the first preheating phase, and (f) supplying hot combustion gases from the outside to the second preheating phase while the charge is moved therethrough until the final temperature of the charge has been adjusted to a desired value, the charge having a temperature of the desired value being introduced from the second preheating phase into the vessel.

2. The steel production process of claim 1, further comprising the step of burning the recovered hot gases before they are brought into contact with the charge in the first preheating phase.

3. The steel production process of claim 1, wherein the charge and hot gases are circulated through the first and second preheating phases in the same direction.

4. The steel production process of claim 1, wherein the charge and hot gases are circulated through the first and second preheating phases in opposite directions.

5. The steel production process of claim 1, wherein the charge and hot gases are circulated through one of the preheating phases in the same direction and through the other preheating phase in the opposite direction.

* * * * *